US006733224B1

(12) United States Patent
Linner

(10) Patent No.: US 6,733,224 B1
(45) Date of Patent: May 11, 2004

(54) FEEDER FOR A TUBE-FILLING MACHINE

(75) Inventor: Hans Linner, Kalmar (SE)

(73) Assignee: Norden Pac Development AB (SE)

( * ) Notice: Subject to any disclaimer, the term of this patent is extended or adjusted under 35 U.S.C. 154(b) by 0 days.

(21) Appl. No.: 10/031,252

(22) PCT Filed: Apr. 20, 2000

(86) PCT No.: PCT/SE00/00769

§ 371 (c)(1),
(2), (4) Date: May 3, 2002

(87) PCT Pub. No.: WO00/64749

PCT Pub. Date: Nov. 2, 2000

(30) Foreign Application Priority Data

Apr. 27, 1999 (DE) ..... 299 07 459 U

(51) Int. Cl.[7] ..... B65B 35/36

(52) U.S. Cl. ..... 414/416.02; 294/87.1; 294/93

(58) Field of Search ..... 414/416.02, 749.5, 414/222.09, 222.12, 226.01; 198/345.1; 294/81.2, 81.62, 93, 87.1

(56) References Cited

U.S. PATENT DOCUMENTS

| | | | | | |
|---|---|---|---|---|---|
| 3,300,945 | A | * | 1/1967 | Grossi et al. | 414/416.02 |
| 4,614,073 | A | | 9/1986 | Argazzi | |
| 4,901,504 | A | | 2/1990 | Tsuji et al. | |
| 5,290,134 | A | * | 3/1994 | Baba | 294/87.1 |
| 5,471,738 | A | * | 12/1995 | Burcham et al. | 29/701 |
| 5,524,416 | A | * | 6/1996 | Linner | 414/416 |
| 5,553,442 | A | * | 9/1996 | Fadaie | 414/786 |
| 5,639,203 | A | * | 6/1997 | Lee | 414/750 |
| 5,704,195 | A | | 1/1998 | Benz | |
| 5,706,634 | A | * | 1/1998 | Edwards et al. | 294/64.1 |
| 5,839,769 | A | * | 11/1998 | Slocum et al. | 294/87.1 |
| 5,934,859 | A | * | 8/1999 | Goetzelmann | 414/416 |
| 6,068,317 | A | * | 5/2000 | Park | 294/87.1 |
| 6,439,631 | B1 | * | 8/2002 | Kress | 294/65 |

FOREIGN PATENT DOCUMENTS

| | | |
|---|---|---|
| GB | 2 203 404 | 10/1988 |
| SE | 449 733 | 5/1987 |
| SE | 468 761 | 3/1993 |
| WO | WO 00/01584 | 1/2000 |
| WO | WO 00/20278 | 4/2000 |

* cited by examiner

*Primary Examiner*—Douglas Hess
(74) *Attorney, Agent, or Firm*—Lerner, David, Littenberg, Krumholz & Mentlik, LLP

(57) ABSTRACT

The present invention relates to feeder assemblies, and more specifically, relates to feeder assemblies for a tube-filling machine. The present invention includes at least one robotic arm capable of moving tubes and tube holders between two locations. The robotic arm may also move the tubes and tube holders relative to one another in order that the distance between adjacent tubes is substantially equal to the holders which carry and house the tubes.

17 Claims, 5 Drawing Sheets

FEEDER FOR A TUBE-FILLING MACHINE

The invention relates to machines/lines which, starting with empty packaging tubes, process these in the machine, including filling and sealing them, and output the tubes from the machine with high productivity/capacity.

More precisely, the invention relates to a feeder intended to constitute a principal component in such a high-production machine.

PRIOR ART

A number of different concepts have been proposed to increase the number of tubes produced per unit of time in a tube-filling line.

In practice, intermittently operating lines have for many years formed the basis for tube handling. Such lines are operationally reliable and can, within certain limits, be converted relatively easily to the actual requirements regarding production volumes, type of sealing, tube dimension, etc.

An advantageous type of intermittently operating machine is based on the principle of the continuous conveyor with two straight sections. Stations for processing the tubes are arranged along one straight section, and the other straight section is used for introducing empty tubes and in certain cases also for discharging filled tubes. The method of working, and the control, of the working tools in the processing stations can be arranged comparatively simply along a straight path. It is possible, for example, to freely adapt the length of the straight path so that a number of identical stations can simultaneously execute the same type of operation on a number of tubes, for example for sealing them. Such extension of the straight section and the provision of multiple stations increase the production volume.

Of course, the production volume per unit of time is also raised by increasing the speed of advance of the conveyor. However, this cannot be increased without restriction since the necessary time for processing in different stations imposes a limit. In addition, there are limits to what the arrangement will tolerate in terms of acceleration and deceleration.

A number of different concepts have been proposed in which, while retaining a partly intermittent operation of a tube-handling line, it has been attempted to increase the number of tubes produced per unit of time.

In such a concept, a continuously operating filling station has been chosen and this has been separated from the stations which are needed for subsequent processing of filled tubes. A traditional, intermittently operating conveyor has been used to convey the tubes to the subsequent processing stations once the tubes have been filled in the filler which is independent of the conveyor.

In this combination of continuous and intermittent operation, it has been proposed to use programmable robots on the one hand between the magazine for empty tubes and the filler, and on the other hand between the filler and the conveyor to the processing stations.

A problem in this context is that it has not been possible to find a simple, adaptable solution to the problem of transferring the tubes between magazine, filler and conveyor.

Also used as transfer arrangements/feeders in connection with tube fillers, especially for transferring empty tubes from a magazine to a conveyor, are feeders which operate on the principle of collecting a number of tubes from a magazine, placing these tubes on an arrangement, usually a conveyor, in order to separate the tubes, after which further arrangements are needed for turning the tubes through 90° so that these, with the correct mutual spacing, can finally be pressed down into holders on the conveyor in the actual tube-filling machine. In terms of their construction, the known feeders thus remain to a large extent tied to the machine, and there is very limited possibility of introducing such a feeder into an environment other than the one for which it was constructed.

OBJECT OF THE INVENTION

The object of the invention is to develop the robot concept in tube-handling lines and to provide an arrangement for a robot which makes available a tube feeder of high capacity and easy adaptability to the requirements set in terms of production volume and production line design.

THE INVENTION

The object of the present invention is achieved by providing a feeder for a tube-filling machine including a sequence of stations located along a continuous conveyor having a plurality of tube holders. The sequence of stations may be adapted for filling and sealing empty packing tubes. Additionally, at least one robot device having an arm may be provided with the assembly in order to transfer the tubes between various locations.

Advantageous developments of the invention are set out in the dependent claims.

BRIEF DESCRIPTION OF THE DRAWINGS

The invention will be described in greater detail below with reference to the attached drawings, in which.

ILLUSTRATIVE EMBODIMENT

Figure 1:
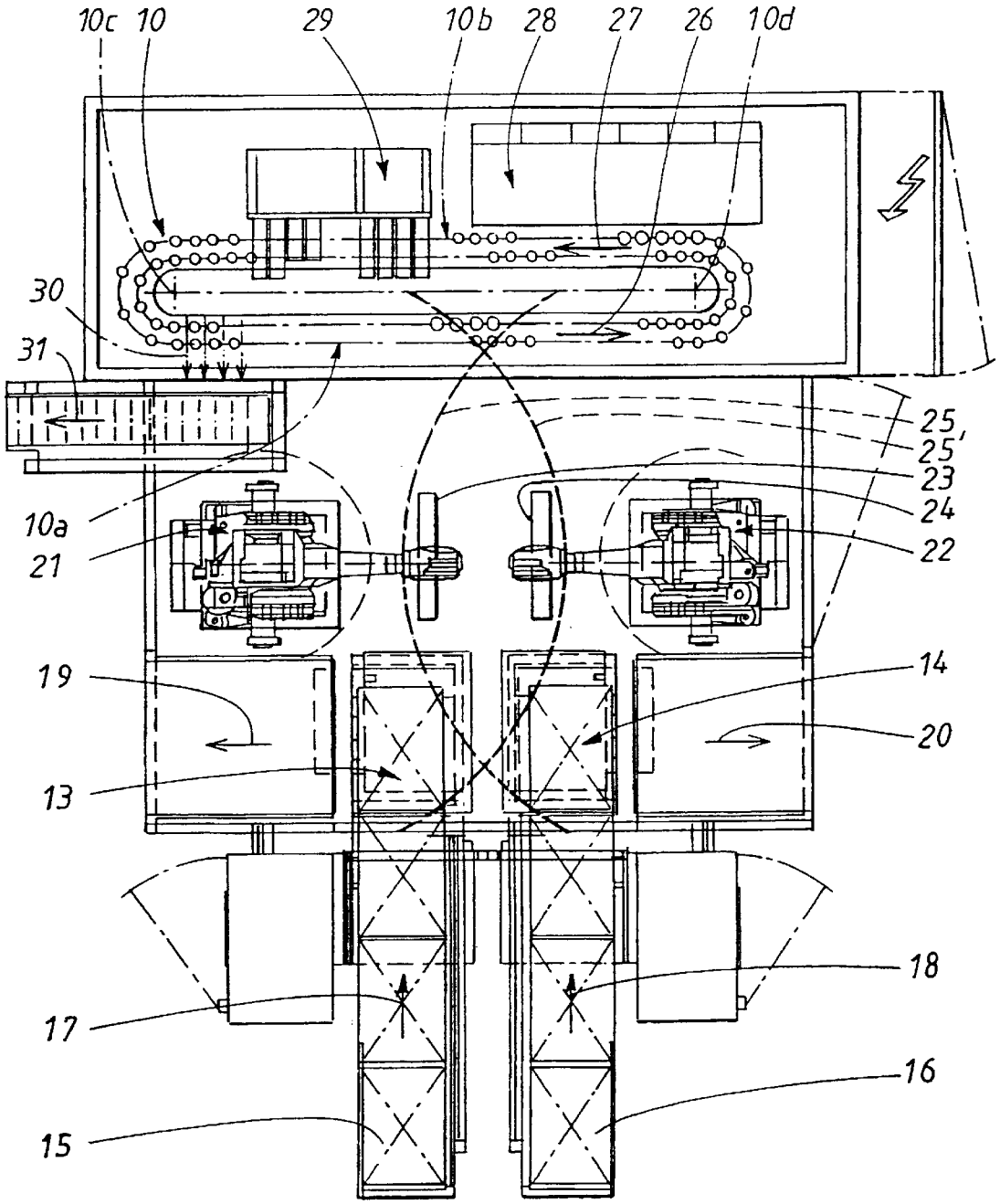
FIG. 1 is a diagrammatic representation of the layout of a tube-handling line with feeders according to the invention.

FIG. 1 shows a layout for a tube-handling machine with high production speed, up to 400–600 tubes per minute.

Figure 2:
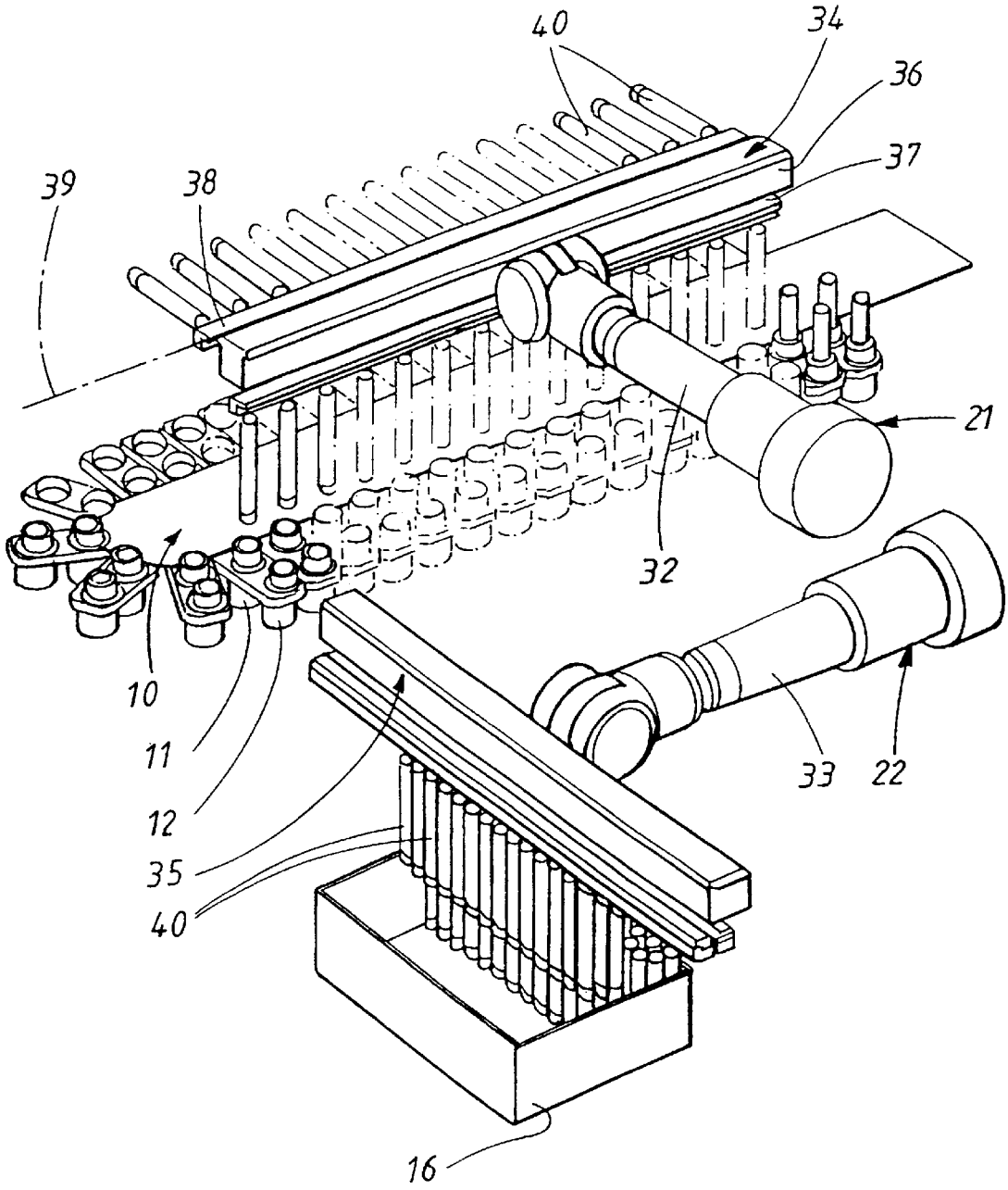
FIG. 2 is a diagrammatic representation, in a perspective view, of two robots with feeders according to the invention, indicating the working method by which the feeders work in the line in FIG. 1.
Figure 3:
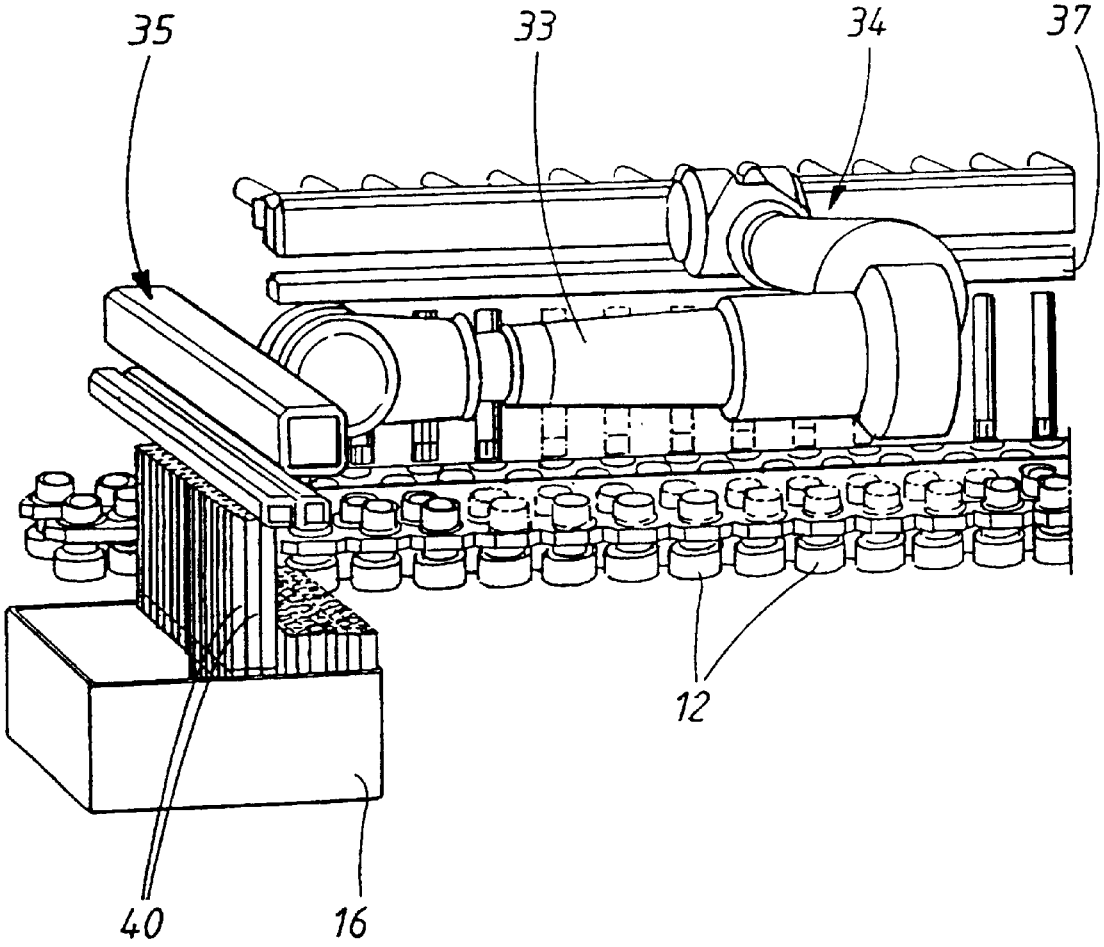
FIG. 3 shows the arrangement from FIG. 2 at a slightly different angle.

The machine has a continuous, intermittently operated conveyor 10 which is placed in the horizontal plane and which has two straight sections 10*a*, 10*b* and passes around deflector wheels 10*c*, 10*d*. Arranged along the conveyor there are double rows of tube holders 11, 12 (FIG. 2). Each pair of tube holders forms a unit, and in the embodiment shown each pair lies with its centre lines in a plane at right angles to the direction of transport, and with well-defined spacing (distance between the centre lines).

In the case in question, the intermittent operation is such that the conveyor advances in steps of a length of two spacings. Assuming that the machine is driven at 100 cycles per minute and that all the tube holders can be used, this gives a production capacity of 2×2×100=400 tubes per minute.

In the layout shown in FIG. 1, there are double collection stations 13, 14 where empty tubes are picked up directly from among tubes arranged in ordered rows in transport packages 15, 16, and where the tubes are arranged with a predetermined centre distance. As soon as a transport package is empty, the next one is advanced to the respective collection station 13, 14 in the direction of the arrows 17, 18.

Empty transport packages are ejected in the direction of the arrows 19, 20.

Two programmable robots 21, 22 with feeders (which will be described later) in the form of beam arrangements 23, 24 collect empty tubes from the transport packages which are located in the collection stations and insert these tubes into the tube holders 11, 12 on the conveyor 10.

The work range of the robot 22 is shown diagrammatically by the broken line 25, and that of the robot 21 by the line 25'.

The tubes are thus inserted into the holders 11, 12 on the straight section 10*a* of the conveyor and are advanced by the said intermittent method in the direction of the arrows 26, 27.

Arranged along the semicircular section 10*d* of the conveyor there are stations (not shown) for tube cleaning and orientation of adornments. The tubes then arrive at a filling station 28 equipped with the necessary number of filling nozzles for the stepped advance in question, in the present case four filling nozzles.

Between the filling station 28 and a heat activation station 29 (for pre-heating of the tube ends), there is a section with devices (not shown) for identifying and ejecting faulty tubes.

After heat activation of the tubes in the station 29, these tubes arrive at a clamping and embossing station where the tube ends are finally sealed.

This is followed by an ejection station (not shown) for faulty tubes.

Filled and approved tubes are finally delivered in the direction of the arrows 30 to a delivery station and are transported in the direction of arrow 31 by means of a delivery conveyor.

FIG. 2 shows, in a simplified perspective view, the principle by which the feed robots 21, 22 work. On the arm of the robot 21 there is a beam arrangement 34 (the arrangement 23 in FIG. 1) which consists of a straight main beam 36 and two straight beam parts 37, 38 of essentially the same length as the main beam. The beam part 38 can be turned by means of a piston/cylinder arrangement (not shown) about an axis of rotation 39 parallel to the main beam 36. Like the other beam parts, the beam part 38 is provided with gripping devices 41 (FIG. 4) intended to grip the tubes 40 from the inside and carry these releasably on the respective beam. In FIG. 2, the beam part 38 is shown with the beam, and with the gripping devices 41 thereon, turned approximately 90° about the axis 39, from a position at right angles to the plane of the conveyor, which coincides with or is parallel to a plane at right angles to the vertical centre axes of the two rows of parallel tube holders.

On the beam part 38, in the same way as on the other beam parts, each gripping device 41 is supported by a holder plate 42 which in turn is supported slidably on a guide arrangement 43 which extends in the longitudinal direction of the beam. The holder plates are connected to each other by a belt 44 with a certain predetermined belt length between adjacent holder plates.

In one end position, the extent of the holder plates in the longitudinal direction of the guide arrangement defines a first, lesser centre distance between the gripping members or devices 41 when the holder plates are driven to a position where they bear against each other. This first lesser centre distance is chosen such that it corresponds to the centre distance between adjacent tubes in rows of tubes in the transport packages in the feed stations 17 and 18, respectively.

In a second end position, the belt 44 defines a second, greater centre distance between the gripping devices 41 when the belt is fully stretched between adjacent holder plates 42. This second, greater centre distance corresponds to the spacing of (centre distance between) the tube holders 11, 12 on the conveyor.

The change-over of the holder plates 42 between the said first and second end positions is effected with the aid of a pair of piston/cylinder arrangements 45, 46 in which each extended piston rod end manoeuvres one of the outer holder plates 42 in the set of holder plates on the guide arrangement 43.

The rotational movement of the beam part 38 about the axis 39 is generated by a further piston/cylinder arrangement (not shown).

Figure 4:
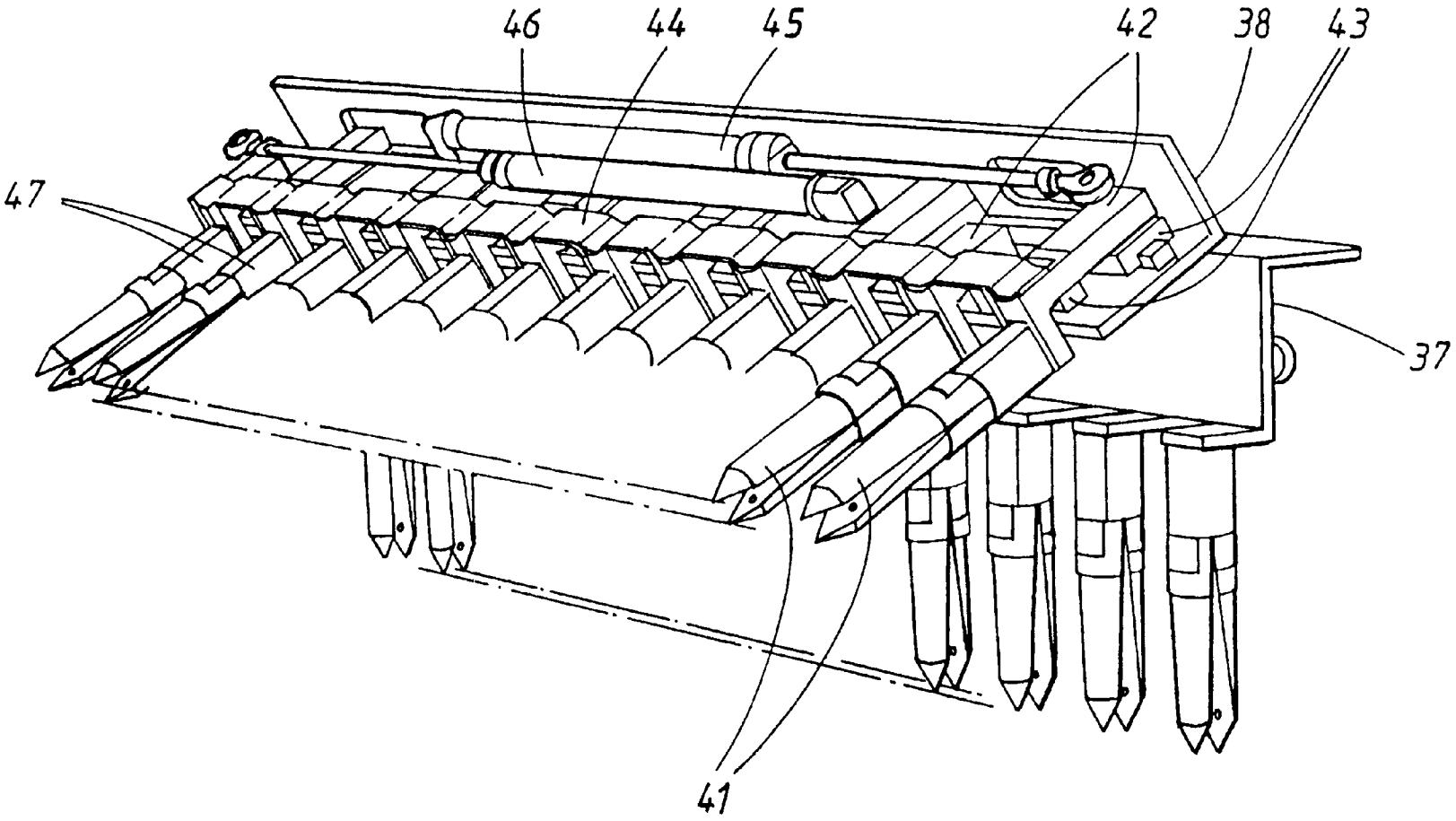
FIG. 4 shows in greater detail the tube-handling members on the beam in the position for insertion, and the means used for positioning the tube-handling members.
Figure 5:
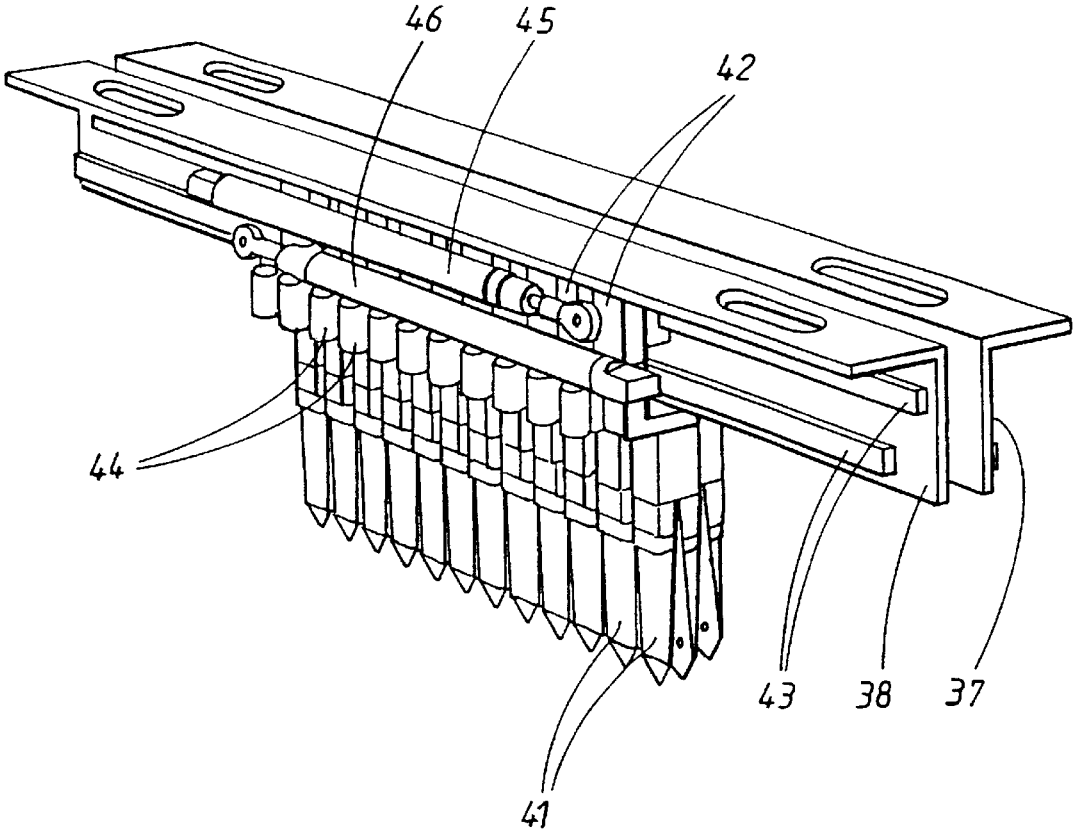
FIG. 5 shows the tube-handling members and the beam in position for collecting empty tubes.

As can be seen from FIG. 4, each gripping device 41 is divided in the longitudinal direction in order to permit pivoting, about a diametral axis in the base plane, of the parts which engage the inside of a tube. This pivoting of the parts of a gripping device is generated with a pneumatic cylinder arrangement 47 belonging to each grip device.

The robot 22 is identical to the robot 21 and has, on its robot arm, the same type of beam arrangement 35 as the robot 21.

In the operating stage shown in FIG. 2, the gripping devices 41 in both the beam sections on the robot 22 are driven together to the minimum centre spacing and the robot arm 31 is in the process of lifting two rows of tubes out of the associated transport packages 15 and 16, respectively.

At the same time, the beam part 37 of the beam arrangement 24 on the robot 21 is in the process of lowering a set of tubes into the outer row of tube holders 12 on the conveyor.

The gripping devices 41 are here driven apart to the defined greater spacing determined by the belt 44.

After the set of tubes on the beam part has been pressed down into the holders 12 in the outer row of holders, the conveyor is advanced in steps of a number of spacings, in the present case two, at the same time as the beam part 38 is turned about its pivot axis 39 to a position in which the gripping devices 41 and the tubes 40 located thereon are oriented vertically. Thereafter, the set of tubes is pressed down into associated holders on the inner row of holders 11 as soon as the said stepped advance has been completed. After this, the robot arm 32 starts its return movement to the collection station 21.

The robot arm 33 of the robot 22 gradually works its way to the tube feed position with the holder plates 44 driven apart and with the beam part 38 turned to the position according to FIG. 2. During this period of time, the tube holders 11, 12 have been advanced sufficiently to permit insertion of the whole set of tubes on the gripping device 41 into tube holders following directly on those in which tubes have already been inserted during the previous stage (by means of the robot 21).

At start-up, manual assistance may be needed for the feed. The reason for this is that on the conveyor side 10*b* where the processing stations are located, there should at all times be tubes in all the tube holders, and in particular in the first ones, before processing is started up.

Although the invention has been described in connection with double rows of tube holders, it will be appreciated that the feeder device according to the invention is not limited to this, and instead it can be applied in general and by means of its basic construction can be easily modified to the requirements in question. The invention is thus limited only by what is stated in the attached patent claims.

What is claimed is:

1. A feeder for a tube-filling machine including a sequence of stations located along a continuous conveyor provided with a plurality of tube holders, the sequence of stations adapted for filling and sealing empty packaging tubes, the continuous conveyor including a straight section adapted for handling empty packaging tubes from a magazine thereof and inserting the empty packaging tubes into the tube holders, the tube holders having a predetermined mutual spacing on the conveyor, the feeder comprising:

at least one robot device having an arm capable of rotating, said arm provided with a beam arrangement, said beam arrangement including at least one elongated straight beam, wherein a plurality of tube-handling members are arranged on said straight beam;

a positioning element for positioning each of said tube-handling members in a first position and moving said tube-handling members into a second position, wherein a distance between adjacent tube-handling members in said first position corresponds to a spacing between said plurality of tube holders on said conveyor and a distance in said second position corresponds to a center distance between a plurality of adjacent tubes in said magazine.

2. The feeder according to claim 1, wherein said beam arrangement includes two elongated straight beams, said beams provided with a set of tube-handling members, wherein at least one of said beams can rotate about an longitudinal axis.

3. The feeder according to claim 2, wherein said tube-handling members are adapted for gripping an inside of said plurality of tubes.

4. The feeder according to any one of claim 1, 2 or 3, wherein two robots are arranged between said magazine and said straight beam arrangement, wherein said robots are programmed to alternatively collect said tubes from said magazine and transfer said tubes into said tube holders.

5. The feeder according to claim 4, wherein said conveyor includes two rows of said plurality of tube holders, wherein said feeder has two beam parts, each with a first set and second set of tube-handling members, said first set of tube-handling members being arranged to insert said tubes into said first row of said tube holders and said second set of tube-handling members arranged to insert tubes into a second row of said tube holders.

6. The feeder according to claim 1, wherein said first position and said second position differ in dimension.

7. A feeder for a tube filling machine, the feeder comprising:

a plurality of tube holders arranged adjacent to one another;

a plurality of tubes arranged adjacent to one another;

at least one robot device having an arm capable of rotating, said arm provided with a beam arrangement, said beam arrangement including at least one elongated straight beam, wherein a plurality of tube-handling members are arranged on said straight beam; and a positioning element for positioning each of said tube-handling members in a first position and moving said tube-handling members into a second position, wherein a distance between adjacent tube-handling members in said first position corresponds to a spacing between said plurality of tube holders and a distance in said second position corresponds to a center distance between said plurality of tubes.

8. The feeder according to claim 7, wherein said beam arrangement includes two elongated straight beams, said beams provided with a set of tube-handling members, wherein at least one of said beams can rotate about an longitudinal axis.

9. The feeder according to claim 7, wherein said tube-handling members are adapted for gripping an inside of said plurality of tubes.

10. The feeder according to any one of claim 7, 8 or 9, further comprising a magazine and a conveyor, wherein two robots are arranged between said magazine and said straight beam arrangement, wherein said robots are programmed to alternatively collect said tubes from said magazine and transfer said tubes into said tube holders.

11. The feeder according to claim 10, wherein said conveyor includes two rows of said plurality of tube holders, wherein said feeder has two beam parts, each with a first set and second set of tube-handling members, said first set of tube-handling members being arranged to insert said tubes into said first row of said tube holders and said second set of tube-handling members arranged to insert tubes into a second row of said tube holders.

12. The feeder according to claim 7, wherein said first position and said second position differ in dimension.

13. A feeder for a tube filling machine, said feeder comprising:

a plurality of tube holders;

a plurality of tubes;

at least one robot device having an arm, said arm provided with a beam arrangement having a longitudinal axis, said beam arrangement including at least two elongated straight beams, wherein at least one of said straight beams includes a set of tube-handling members arranged on said beam, wherein at least one of said beams can rotate about said longitudinal axis; and a positioning element for positioning each of said tube-handling members in a first position and moving said tube-handling members into a second position, wherein a distance between said tube-handling members in said first position corresponds to a spacing between said plurality of tube holders and a distance in said second position corresponds to a center distance between said plurality of tubes.

14. The feeder according to claim 13, wherein said tube-handling members are adapted for gripping an inside of said plurality of tubes.

15. The feeder according to any one of claim 13 or 14, further comprising a magazine and a conveyor, wherein two robots are arranged between said magazine and said straight beam arrangement, wherein said robots are programmed to alternatively collect said tubes from said magazine and transfer said tubes into said tube holders.

16. The feeder according to claim 15, wherein said conveyor includes two rows of said tube holders, wherein said feeder has two beam parts, each with a first set and second set of tube-handling members, said first set of tube-handling members being arranged to insert said tubes into said first row of said tube holders and said second set of tube-handling members arranged to insert tubes into said second row of said tube holders.

17. The feeder according to claim 13, wherein said first position and said second position differ in dimension.

* * * * *

UNITED STATES PATENT AND TRADEMARK OFFICE

CERTIFICATE OF CORRECTION

PATENT NO. : 6,733,224 B1
DATED : May 11, 2004
INVENTOR(S) : Hans Linner

It is certified that error appears in the above-identified patent and that said Letters Patent is hereby corrected as shown below:

Column 2,
Line 6, "In" should begin a new paragraph.

Column 5,
Line 42, delete "claim" and in place thereof insert -- claims --.

Column 6,
Lines 15 and 53, delete "claim" and in place thereof insert -- claims --.

Signed and Sealed this

Twentieth Day of July, 2004

JON W. DUDAS
*Acting Director of the United States Patent and Trademark Office*